US005513440A

United States Patent [19]

Murg

[11] Patent Number: 5,513,440

[45] Date of Patent: May 7, 1996

[54] DEVICE FOR ADJUSTING THE RETICLE OF AN AIMING TELESCOPE

[75] Inventor: Erwin Murg, Neu-Rum, Austria

[73] Assignee: Swarovski Optik KG, Absam, Austria

[21] Appl. No.: 248,746

[22] Filed: May 25, 1994

[30] Foreign Application Priority Data

Dec. 2, 1993 [DE] Germany ..... 43 41 151.7

[51] Int. Cl.[6] ..... G02B 27/36

[52] U.S. Cl. ..... 33/246; 33/298; 33/248; 359/428

[58] Field of Search ..... 33/233, 245, 246, 33/247, 248, 297, 298; 292/347; 359/417, 418, 427, 428

[56] References Cited

U.S. PATENT DOCUMENTS

| | | | |
|---|---|---|---|
| 2,165,796 | 7/1939 | Humeston | 33/248 |
| 2,336,107 | 12/1943 | Litschert | 33/248 |
| 3,826,012 | 7/1974 | Pachmayr | 33/246 |
| 3,990,155 | 11/1976 | Akin, Jr. et al. | 33/246 |
| 4,038,757 | 8/1977 | Hicks et al. | 33/247 |
| 4,200,355 | 4/1980 | Williams, Jr. | 33/246 |
| 4,247,161 | 1/1981 | Unertl, Jr. | 33/246 |
| 5,363,559 | 11/1994 | McCarty | 33/246 |

FOREIGN PATENT DOCUMENTS

| | | | |
|---|---|---|---|
| 598306 | 2/1948 | United Kingdom | 33/246 |

*Primary Examiner*—William A. Cuchlinski, Jr.
*Assistant Examiner*—G. Bradley Bennett
*Attorney, Agent, or Firm*—Fay, Sharpe, Beall, Fagan, Minnich & McKee

[57] ABSTRACT

A device for adjusting the reticle of an aiming telescope has a pair of threaded spindles disposed at right angles to each other and engaging a thread in an intermediate housing on the main tube. The threaded spindles act on an inner tube with the reticle mounted movably within the main tube. The threaded spindles are connected in rotationally firm fashion with a snap-in locking device which engages snap-in recesses in the intermediate housing distributed about the threaded spindle. The index plate provided is an axially displaceable turning knob to be coupled with the snap-in locking device by positive locking.

15 Claims, 3 Drawing Sheets

DEVICE FOR ADJUSTING THE RETICLE OF AN AIMING TELESCOPE

BACKGROUND OF THE INVENTION

The present invention relates to a device for adjusting the reticle of an aiming telescope having threaded spindles disposed at an angle to each other to engage a thread in an intermediate housing on the main tube and act on the inner tube with the reticle mounted movably within the main tube, a snap-in locking device connected with each threaded spindle in rotationally firm fashion and engaging snap-in recesses in the intermediate housing distributed about the threaded spindle, and a rotary member to be coupled with the snap-in locking device and having a marking which is adjustable by rotating the rotary member to a marking fixed on the telescope.

Such adjusting devices are known. For adjustment a pair of threaded spindles disposed perpendicular to each other are generally rotated so that the reticle in the inner tube is shifted perpendicular to the main tube axis until it coincides with the meeting point. These spindles are usually operated via a coin slot or a small grip bar on the top of the spindle. The snap-in locking device connected with the spindle via a ring in rotationally firm fashion serves as a locking piston and helps the user select the necessary adjusting distance. That is, the snap-in recesses in the intermediate housing can be a distance apart such that the angle of rotation covered by the snap-in locking device from one recess to the next corresponds to a deviation from the meeting point of e.g. 1 cm for a certain range, for example 100 m. The lock into the next snap-in recess can generally be both felt and heard.

The rotary member for marking the set adjustment in the known device is an index plate disposed rotatably on a ring on the threaded spindle and fixable e.g. with a screw. For setting the basic adjustment the screw is loosened so that the index plate can be aligned with the marking fixed on the telescope, i.e. a zero point on the main tube.

The known device is disadvantageous in that a coin must be used for a coin slot and, on the other hand, it is troublesome to perform correct adjustment with the small grip bar which is difficult to grip. Furthermore a tool is required for operating the screw on the index plate.

The invention is therefore based on the problem of providing an easy-to-operate aiming telescope adjusting device for precise adjustment without tools.

SUMMARY OF THE INVENTION

The precise adjustment without tools is obtained according to the invention by an adjusting device wherein the rotary member for marking the set adjustment is formed as an axially displaceable turning knob to be coupled with the snap-in locking device by positive locking.

In the inventive device the turning knob thus has two axial end positions, the positive coupling between turning knob and snap-in locking device being disengaged in the pulled-out end position, and this coupling being engaged in the pushed-in end position. In the disengaged end position the turning knob is pulled out. This snap-in locking device is preferably fastened to a hub which is positively connected with the threaded spindle, for example by a serration, a polygon or a projection engaging an axial groove.

For fixing the turning knob in the engaged or disengaged end position the hub has a pair of recesses, for example annular grooves, at an axial distance, whereby the turning knob has at least one catch spring engaging one or the other recess in the hub.

The snap-in locking device or the hub is rotatably mounted on the intermediate housing. The positive locking for coupling the snap-in locking device with the turning knob is preferably effected by a toothing provided on the inside of the turning knob. This toothing is engaged in the pushed-in setting of the turning knob by at least one spring member fastened to the snap-in locking device. For this purpose the spring member is supported on the turning knob when the latter is in the pushed-in position.

To support the spring member on the turning knob the latter preferably has an annular groove whose inner groove face urges the spring member against the outer groove face provided with the toothing.

The inventive adjusting device permits ergonomic operation due to the turning knob which has a nonslip, e.g. knurled, circumference for example. Also, no additional tool is required for setting the basic adjustment. There is a simple positive connection between turning knob and snap-in locking device which can be unlocked by pulling up the turning knob. The device can be disposed on the aiming telescope about the threaded spindle in space-saving fashion. The housing for the snap-in locking device, the hub and the spring members and also the turning knob with the catch springs can be formed cost-effectively by just one plastic part since they have no influence on the precision of adjustment.

BRIEF DESCRIPTION OF THE DRAWINGS

In the following an embodiment of the inventive adjusting device will be explained in more detail with reference to the drawing, in which.

THE PREFERRED EMBODIMENTS

Figure 1:
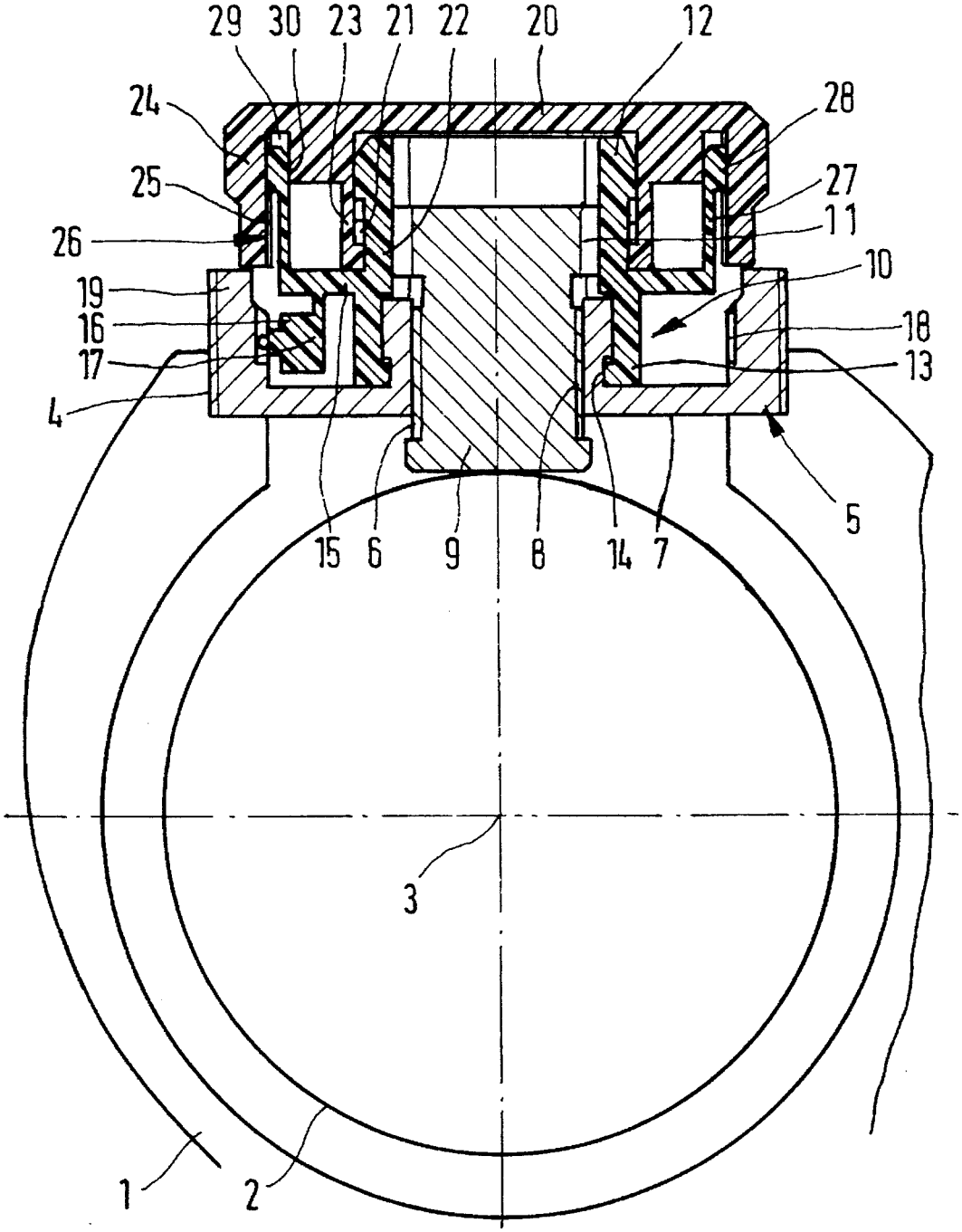
FIG. 1 shows in cross section a partial view of an aiming telescope.

Within main tube 1 of an aiming telescope, inner tube 2 bearing the reticle 40 is movably mounted perpendicular to longitudinal tube axis 3, for example by a ball-and-socket joint (not shown) between one end of inner tube 2 and main tube 1.

Main tube 1 has bore 4 in which intermediate housing 5 is fastened. Intermediate housing 5 is cup-shaped and has internally threaded sleevelike portion 8 on axial bore 6 in bottom 7.

Threaded spindle 9 is screwed into portion 8 to act with one end on inner tube 2 so that upon rotation of threaded spindle 9 the reticle in inner tube 2 is shifted perpendicular to tube axis 3.

Threaded spindle 9 is connected with hub 10 in rotationally firm fashion by serration 11 which is provided on axially outer portion 12 of hub 10 facing away from inner tube 2. Axially inner portion 13 of hub 10, on the other hand, is mounted rotatably on portion 8 of intermediate housing 5 but axially fixed by engagement in groove 14 in portion 8.

Between axially outer portion 12 and inner portion 13 disk-shaped ring portion 15 extends radially outward from hub 10. Fastened to the axial inside of ring portion 15, i.e. facing inner tube 2, is a snap-in locking device with housing 16 in which a radially outward spring-loaded ball or similar catch member is displaceably mounted. Catch member 17 cooperates with snap-in recesses 18 provided on the inside of wall 19 of cup-shaped intermediate housing 5, said wall extending outward away from bottom 7 like portion 8.

On axially outer portion 12 of hub 10 turning knob 20 is mounted so as to be rotatable and axially displaceable, at the same time closing cup-shaped intermediate housing 5 with hub 10 and threaded spindle 9.

Turning knob 20 has two axial end positions, namely a pulled-out end position and the pushed-in end position shown in the drawing. The two axial end positions are fixable by a pair of annular grooves or similar recesses 21, 22 on the outside of outer hub portion 12 which are engaged by catch springs 23 fastened to turning knob 20.

In the pushed-in end position shown in the drawing in which catch springs 23 engage groove 22, turning knob 20 is coupled by positive locking, i.e. connected in rotationally firm fashion, with ring portion 15 of hub 10 and thus with snap-in locking device 17, and in the pulled-out end position in which catch springs 23 engage groove 21 it is decoupled, i.e. freely rotatable.

For this purpose toothing 25 is firstly provided on the inside of the wall of cup-shaped turning knob 20. Secondly, spring members 26 are mounted on ring portion 15 of hub 10 which each comprise spring portion 27 and member 28 engaging toothing 25 at the end of spring portion 27. Spring members 26 are distributed evenly about ring portion 15.

Annular groove 29 extends in turning knob 20 about toothing 24. In the engaged position shown in the drawing inner groove face 30 urges member 28 into engagement with toothing 25 on the outer groove face or the inside of wall 24 of turning knob 20. In the disengaged position in which turning knob 20 is pulled out, member 28 is moved out of annular groove 29, i.e. the pressure from inner groove face 30 no longer exists, so that member 28 gives way radially inward upon rotation of knob 20 thereby detaching toothing 25. In the pulled-out end position turning knob 20 can therefore be rotated independently of snap-in locking device 28 and thus independently of spindle 9. Turning knob 20 is provided with an index marking 50 so that it simultaneously performs the function of the above-described index plate of known adjusting devices.

Spindle 9 and intermediate housing 5 are made of metal. Turning knob 20 with catch springs 23 is made of plastic; hub 10 with portions 12, 13, ring portion 15, housing 16 for snap-in locking device 17 and spring members 26 also consists of a plastic part.

Turning knob 20 is provided with an index marking, e.g. a line. For adjustment one pulls out turning knob 20 into one end position and then adjusts the index marking on turning knob 20 to a marking fixed on the telescope, e.g. a point as a zero mark, on intermediate housing 5. Turning knob 20 is then pushed into the other end position and the aiming telescope adjusted. That is, rotating turning knob 20 and thus spindle 9 shifts inner tube 2 until the reticle contained therein coincides with the meeting point. For this purpose two spindles are operated, i.e. not only spindle 9 shown in the drawing but also a spindle disposed perpendicular thereto on the aiming telescope, which cannot be seen in the drawing.

This effects the basic adjustment, whereupon the index marking of the turning knob is brought into agreement with the zero mark on intermediate housing 5 again by pulling out, rotating and pushing in turning knob 20.

Figure 3:
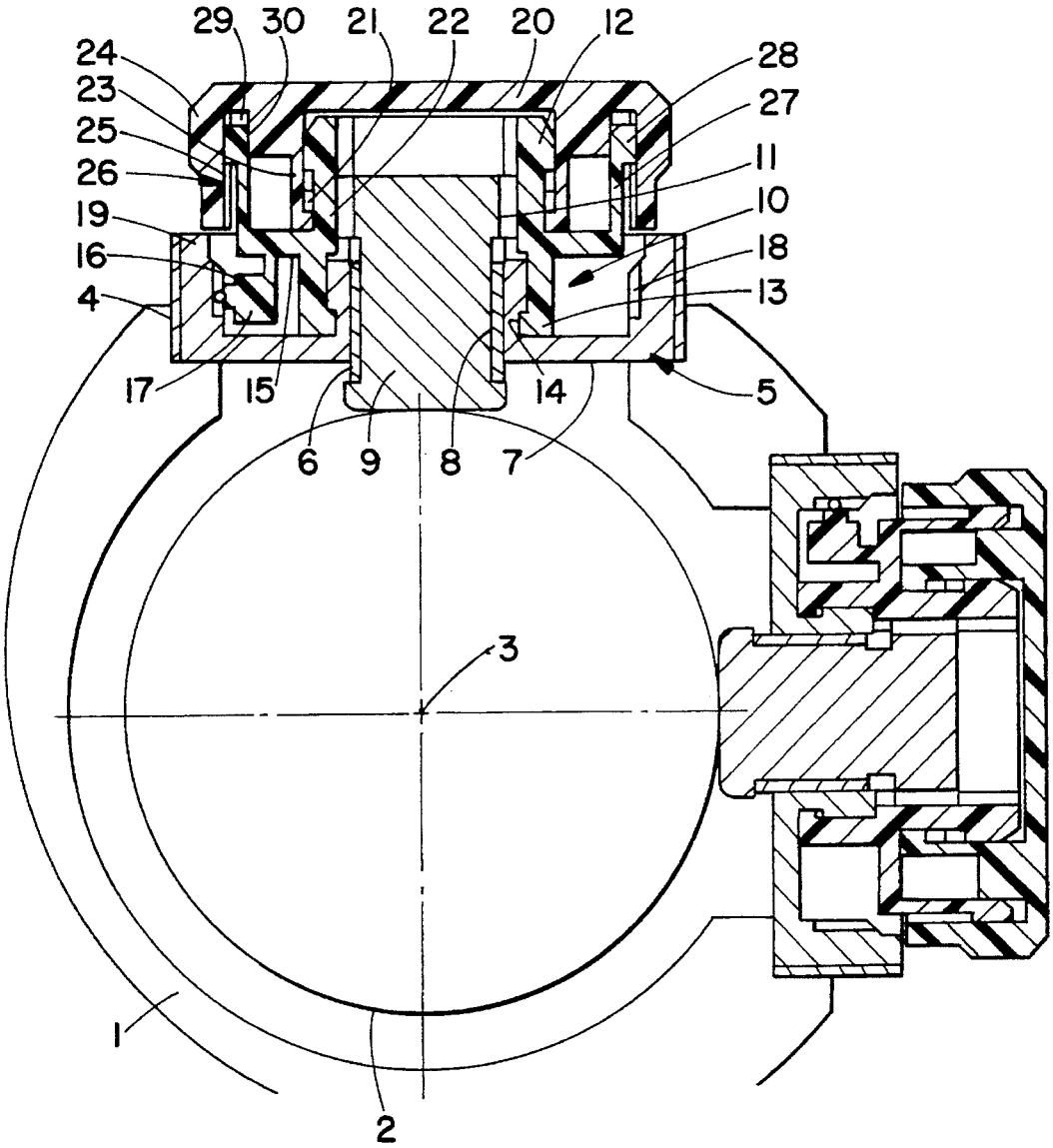
FIG. 3 shows in cross-section a partial view of an aiming telescope having two devices for adjusting the reticle of the aiming telescope.

FIG. 3 shows a second device for adjusting the reticle of an aiming telescope identical to the device described in connection with FIG. 1. As the second device illustrated in FIG. 3 is identical in construction to the device described in FIG. 1 its construction will not again be described in detail.

Figure 2:
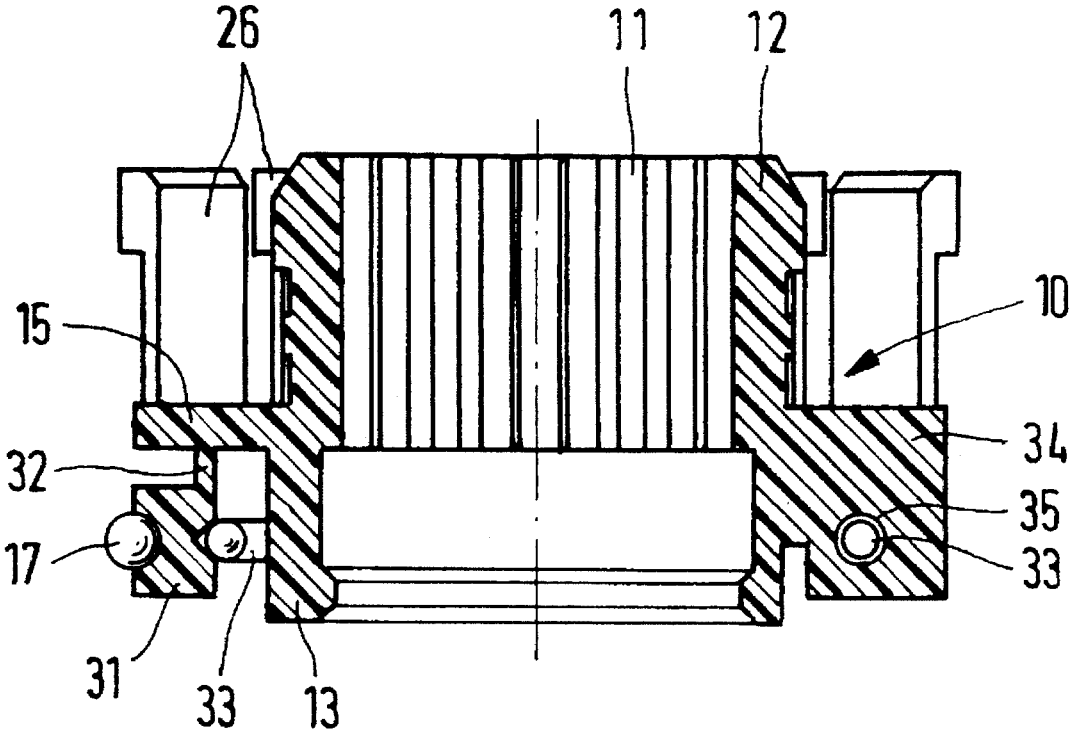
FIG. 2 shows a section through the part of the device having the hub and the snap-in locking device, the snap-in locking device being formed differently to that in FIG. 1.

FIG. 2 shows the plastic part comprising hub 10 with portions 12, 13, ring portion 15 and spring members 26 disposed about ring portion 15.

Compared to the embodiment in FIG. 1, however, the snap-in locking device is formed differently. Instead of housing 16 with the spring-loaded ball or similar locking members 17 mounted displaceably therein according to FIG. 1, holding device 31 formed as a block is pivoted to ring or circumferential portion 15 in FIG. 2 for a ball fastened rigidly thereto, e.g. made of steel, or similar catch member 17. For this purpose holding device 31 is fastened to ring portion 15 via bar 32 formed as a plastic hinge.

For spring loading the snap-in locking device, i.e. holding device 31 with catch member 17, spring ring 33, e.g. a steel ring, with a slightly oval cross section is provided which extends about portion 13 of hub 10. Spring ring 33 is supported on the radial inside of holding device 31 facing away from snap-in locking device 17. For fastening spring ring 33 the plastic part shown in FIG. 2 has projection 34 on ring portion 15 on the side of hub portion 13 opposing holding device 31. Projection 34 is provided with bore 35 for receiving spring ring 33. Spring ring 33 can be slotted. It is then inserted in bore 35 with one end from one side and with the other end from the other side.

I claim:

1. A device for adjusting the reticle of an aiming telescope having threaded spindles disposed at an angle to each other to engage a thread in an intermediate housing on a main tube and act on an inner tube with the reticle mounted movably within the main tube, a snap-in locking device connected with each threaded spindle in rotationally firm fashion and engaging snap-in recesses in the intermediate housing distributed about the threaded spindle, and a rotary member to be coupled with the snap-in locking device and having a marking which is adjustable by rotating the rotary member to a marking fixed on the telescope, characterized in that the rotary member is formed as an axially displaceable turning knob (20) to be coupled with the snap-in locking device by positive locking.

2. The device of claim 1, characterized in that the snap-in locking device is fastened to a hub (10) connected with the threaded spindle (9) in rotationally firm fashion.

3. The device of claim 2, characterized in that a serration (11) is provided for the rotationally firm connection between threaded spindle (9) and hub (10).

4. The device of claim 2, characterized in that the hub (10) is mounted on the intermediate housing (5).

5. The device of claim 2, characterized in that for fixing the turning knob (20) in an engaged or disengaged end position, the hub (10) has a pair of recesses (21, 22) at an axial distance, and the turning knob (20) has at least one catch spring (23) engaging one or the other recess (21, 22).

6. The device of claim 2, characterized in that the turning knob (20) is cup-shaped and for the positive locking between snap-in locking device and turning knob (20) a toothing (25) is provided on the inner wall (24) of the turning knob, and at least one spring member (26) engaging the toothing (25) and urged into the engaged position by the turning knob (20) is provided on the snap-in locking device.

7. The device of claim 6, characterized in that the turning knob (20) has an annular groove (29) whose inner groove face (30) urges the spring member (26) against the toothing (25).

8. The device of claim 2, characterized in that the hub (10) has a circumferential portion (15) to which spring members (26) and the snap-in locking device are fastened.

9. The device of claim 8, characterized in that the snap-in locking device has a housing (16) fastened to the circumferential portion (15) with a catch member (17) mounted displaceably therein.

10. The device of claim 8, characterized in that the snap-in locking device has a holding device (31) with the catch member (17) pivoted to the circumferential portion (15).

11. The device of claim 10, characterized in that for spring loading the snap-in locking device radially outward a spring ring (33) is provided which extends about the hub (10) and is fastened to the circumferential portion (15).

12. The device of claim 9, characterized in that the hub (10), the circumferential portion (15), the spring members (26) as well as one of the housing (16) and the holding device (31) of the catch member (17) of the snap-in locking device consist of one plastic part.

13. The device of claim 3, characterized in that the hub (10) is mounted on the intermediate housing (5).

14. The device of claim 10, characterized in that the hub (10), the circumferential portion (15), the spring members (26) as well as the housing (16) or the holding device (31) of the catch member (17) of the snap-in locking device consist of one plastic part.

15. A device for adjusting the reticle of an aiming telescope having threaded spindles disposed at an angle to each other to engage a thread in an intermediate housing on a main tube, and act on an inner tube with the reticle mounted movably within the main tube, the device comprising:

a snap-in locking device connected with each threaded spindle in rotationally firm fashion and engaging snap-in recesses in the intermediate housing distributed about the threaded spindle; and a rotary member attached to the snap-in locking device, having a marking which is adjustable by rotating the rotary member to a marking fixed on the aiming telescope, the rotary member being formed as a two position turning knob with a first position being a pulled-out end position whereby the turning knob is rotated independently of the snap-in locking device and a second position being a pushed-in position whereby the turning knob is positively locked with the snap-in locking device.

* * * * *